US007415346B2

(12) United States Patent
Musashi et al.

(10) Patent No.: US 7,415,346 B2
(45) Date of Patent: Aug. 19, 2008

(54) AIR INTAKE DEVICE, SENSOR UNIT, TWO-WHEELED VEHICLE, AND INTAKE AIR TEMPERATURE DETECTION METHOD

(75) Inventors: Kazuhiro Musashi, Odawara (JP); Osamu Miura, Odawara (JP)

(73) Assignee: Mikuni Corporation, Tokyo (JP)

( * ) Notice: Subject to any disclaimer, the term of this patent is extended or adjusted under 35 U.S.C. 154(b) by 148 days.

(21) Appl. No.: 11/394,082

(22) Filed: Mar. 31, 2006

(65) Prior Publication Data

US 2006/0174701 A1 Aug. 10, 2006

Related U.S. Application Data

(63) Continuation of application No. PCT/JP2004/015595, filed on Oct. 21, 2004.

(30) Foreign Application Priority Data

Oct. 22, 2003 (JP) ..... 2003-361562

(51) Int. Cl.
*F02D 35/00* (2006.01)

(52) U.S. Cl. ..... 701/103; 123/399; 701/114

(58) Field of Classification Search ..... 701/103, 701/114, 115; 123/337, 399, 361; 73/117.3, 73/118.1

See application file for complete search history.

(56) References Cited

U.S. PATENT DOCUMENTS 4,388,906 A * 6/1983 Sugiyama et al. ..... 123/492
5,153,835 A * 10/1992 Hashimoto et al. ..... 701/114

FOREIGN PATENT DOCUMENTS

| | | | |
|---|---|---|---|
| JP | 63-134844 | A * | 6/1988 |
| JP | 7-260534 | | 10/1995 |
| JP | 9-222043 | | 8/1997 |
| JP | 2003-74379 | | 3/2003 |

* cited by examiner

*Primary Examiner*—Hieu T Vo
(74) *Attorney, Agent, or Firm*—Wenderoth, Lind & Ponack, L.L.P.

(57) ABSTRACT

A temperature sensor is disposed at a position upstream of a throttle shaft in the flow channel so as not to contact the throttle valve. An inlet of a guiding path in the flow channel is arranged downstream of a first half part of the throttle valve that is revolved in an upstream direction when the throttle valve is revolved in an opening direction, the guiding path guiding a pressure to the pressure sensor. A first screw which attaches the sensor unit to the throttle body is disposed at a position upstream of a half part. A second screw is disposed at a position downstream of the other half part. A detected temperature of intake air is corrected to a temperature of intake air detected near an air cleaner.

11 Claims, 9 Drawing Sheets

AIR INTAKE DEVICE, SENSOR UNIT, TWO-WHEELED VEHICLE, AND INTAKE AIR TEMPERATURE DETECTION METHOD

This is a Continuation Application of International Application No. PCT/JP2004/015595, filed Oct. 21, 2004.

TECHNICAL FIELD

The present invention relates to an air-intake device in an internal combustion engine, a sensor unit to be attached to a throttle body, a two-wheeled vehicle including the same, and an intake air temperature detection method.

BACKGROUND ART

In an air-intake system of an engine, an intake air temperature sensor, a pressure sensor, a valve rotation sensor and the like are attached to the air intake system. Conventionally, these sensors are independently mounted such that an intake air temperature sensor is mounted to an air cleaner, a pressure sensor is mounted to a throttle body, an intake manifold, or a special housing, and a valve rotation sensor is mounted to a throttle body. Since each sensor requires special wiring or a mounting mechanism, wiring becomes complicated, leading to a complicated installation process. In addition, as the FI (fuel injection) engine system prevails, sensors are demanded to be installed in a compact and modular manner. In response to such a demand, those having a unit made up of a pressure sensor and an intake air temperature sensor, mounted to an intake tube on the upstream side of a throttle body have been proposed (see Patent document 1).

Patent document 1: Japanese Patent Application Laid-Open Publication No. H7-260534

SUMMARY OF INVENTION

Problem to be Solved by the Invention

The present invention is achieved in view of the above problems, and it is an object of the present invention to provide an air-intake device to which an intake air temperature sensor and a pressure sensor are mounted as a unit to be compact, the sensor unit, a two-wheeled vehicle including the same, and an intake air temperature detection method.

Means for Solving Problem

An air-intake device according to the present invention is an air-intake device using a butterfly-type throttle valve in which a sensor unit having an intake air temperature sensor and a pressure sensor is mounted on a throttle body. The intake air temperature sensor is disposed at a position on an upstream side of a throttle shaft in a flow channel of the throttle body so as not to contact the throttle valve, an inlet in the flow channel of a pressure guiding path that guides a pressure to the pressure sensor is disposed on a downstream side of a first half part of the throttle valve, the first half part being revolved upstream when the throttle valve is revolved in an opening direction, and a first attaching unit that attaches the sensor unit to the throttle body is disposed on the upstream side of the first half part, and a second attaching unit that attaches the sensor unit to the throttle body is disposed on the downstream side of a second half part, the second half part being revolved downstream when the throttle valve is revolved in an opening direction.

Moreover, in the air-intake device according to the present invention, the sensor unit has an intake air temperature sensor attaching portion that attaches the intake air temperature sensor, the intake air temperature sensor attaching portion projects into the flow channel along the throttle shaft from the inner peripheral wall of the flow channel, and a length by which the intake air temperature sensor projects from the inner peripheral wall is equal to or less than approximately ½ of an inside diameter of the flow channel.

Furthermore, in the air-intake device according to the present invention, the first and the second attaching units are positioned on a side of the flow channel at portions where a distance from an axial center of the throttle shaft is equal to or less than approximately ½ on a transverse section of the flow channel.

Moreover, the air-intake device according to the present invention, a throttle position sensor is attached to the throttle shaft.

Furthermore, an air-intake device according to the present invention includes an intake air temperature sensor disposed on an upstream side of a throttle shaft within a flow channel of a throttle body so as not to contact the throttle valve; and a correction circuit that corrects a detection value detected by the intake air temperature sensor into a value of intake air temperature near an air cleaner.

Moreover, the air-intake device according to the present invention further includes a memory that stores an intake air temperature map value. The correction circuit corrects the detection value based on the intake air temperature map value stored in the memory.

Furthermore, in a sensor unit according to the present invention, at least two projection members are disposed in a part contacting a cross section of an inlet of an intake air temperature sensor guiding path of an intake air temperature sensor attaching portion, and the projection members and the cross section of the inlet of the intake air temperature sensor guiding path abut to each other.

Moreover, in the sensor unit according to the present invention, each of the projection members is disposed at a constant interval from neighboring one of the projection members.

Furthermore, a two-wheeled vehicle according to the present invention includes the air-intake device.

Moreover, a two-wheeled vehicle according to the present invention includes the sensor unit.

Furthermore, a two-wheeled vehicle according to the present invention includes at least one of the air-intake device and the sensor unit.

Moreover, an intake air temperature detection method according to the present invention includes acquiring a detection value from an intake air temperature sensor disposed on an upstream side of a throttle shaft within a flow channel of a throttle body so as not to contact the throttle valve; correcting the detection value acquired at the acquiring into a value of intake air temperature near an air cleaner; and outputting a value corrected at the correcting.

Furthermore, in the intake air temperature detection method according to the present invention, the correcting includes correcting the detection value based on an intake air temperature map value stored in advance in a predetermined memory.

EFFECT OF THE INVENTION

As described above, according to the present invention, it is possible to mount an intake air temperature sensor and a pressure sensor in a compact manner on an air-intake device.

EXPLANATIONS OF LETTERS OR NUMERALS

Figure 1:
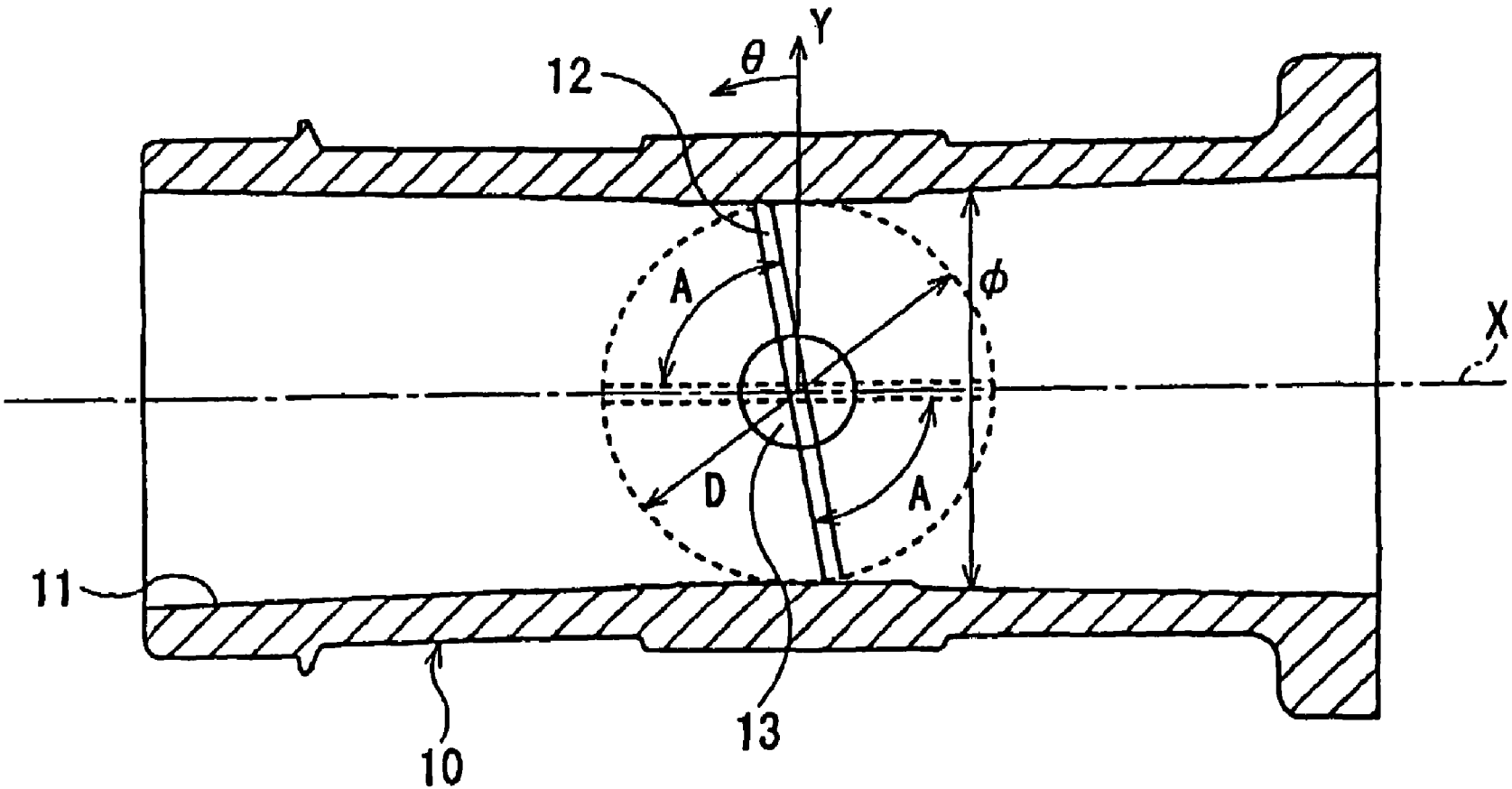
FIG. 1 is a schematic side cross-section of an air-intake device taken along a flow channel and viewed from a direction of an axis of a throttle shaft.

10 Throttle body
11 Flow channel
12 Throttle valve
13 Throttle shaft
15 Pressure guiding path
16, 17 Screw hole
20 Sensor unit
21 TPS
22 Intake air temperature sensor
23 Pressure sensor
24 Temperature sensor attaching portion
30, 31 Screw
40 (40*a* to 40*d*) Projecting member
42 Cross section of an inlet of an intake air temperature sensor guiding path
50 Correction circuit
51 Intake air temperature map value memory

DETAILED DESCRIPTION OF PREFERRED EMBODIMENTS

Figure 2:
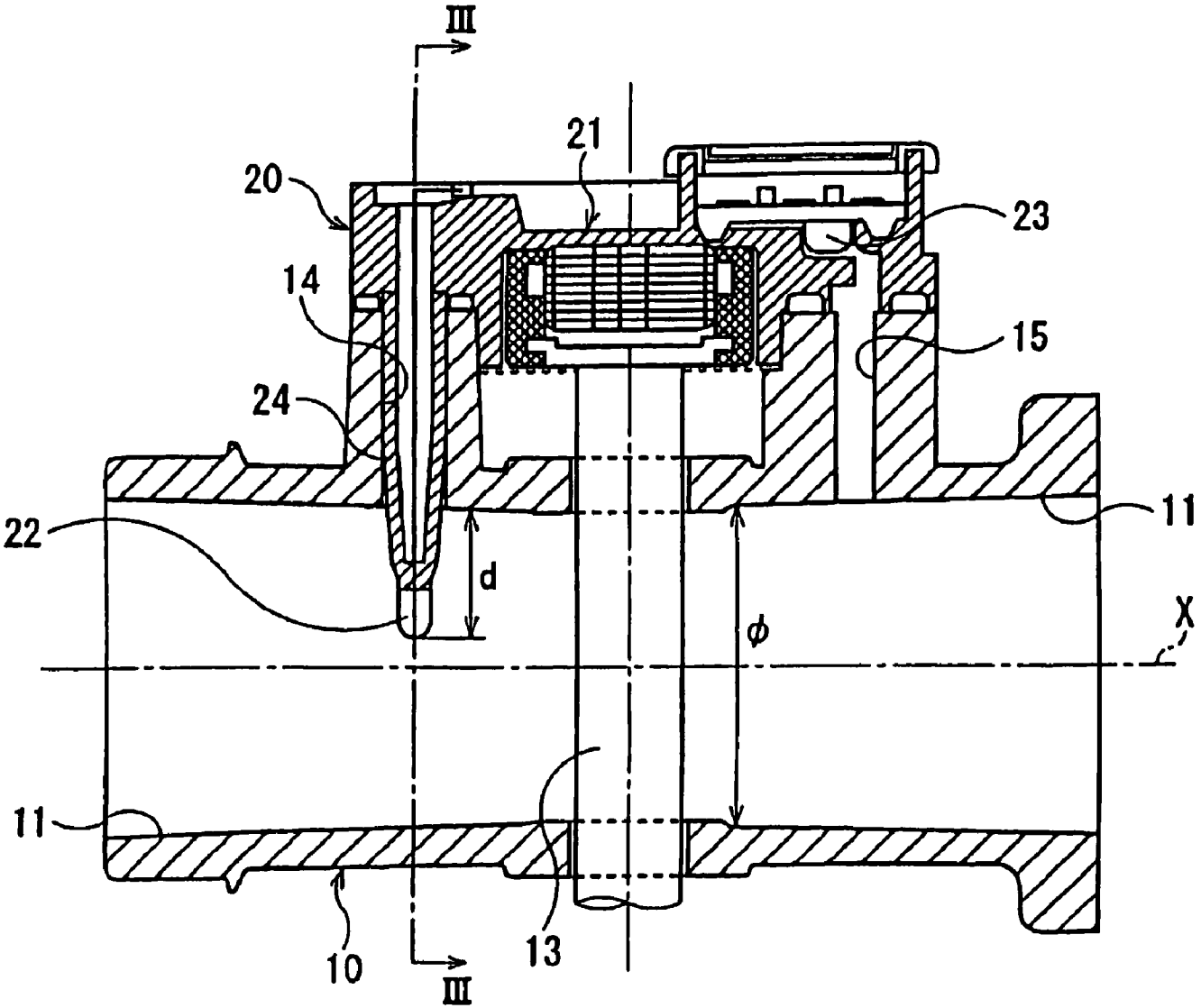
FIG. 2 is a schematic cross-section of the air-intake device taken along the flow channel and viewed from a direction perpendicular to the axis of the throttle shaft, which corresponds to a cross-section taken along a line II-II shown in FIG. 6.

Exemplary embodiments of the present invention will be explained below with reference to the drawings. FIG. 1 and FIG. 2 are schematic cross-sections of an air-intake device according to an embodiment of the present invention, taken along a flow channel thereof. FIG. 1 is a side cross-section taken along an axis of a throttle shaft, and FIG. 2 is a cross-section taken along a line II-II shown in FIG. 6.

In a central portion of a throttle body 10, a cylindrical flow channel 11 is provided. A left side of the throttle body 10 shown in FIGS. 1 and 2 is an upstream side of the channel 11 and a right side of the throttle body 10 shown in FIGS. 1 and 2 is a downstream side of the channel 11. In substantially the center of the flow channel 11, a butterfly type throttle valve 12 is provided. The throttle valve 12 is held by a throttle shaft 13 that perpendicularly traverses substantially the center of the flow channel 11.

The throttle shaft 13 is rotatable with respect to the throttle body 10, and opening/closing of the throttle valve 12 is operated through rotation of the throttle shaft 13. In FIG. 1, a position of the throttle valve 12 in a full-close state is depicted with a solid line, and a position of the throttle valve 12 in a full-open state is depicted with a broken line. A movable range of the throttle valve 12 is represented by an arrow A. That is, in FIG. 1, when the throttle shaft 13 is rotated counterclockwise, the throttle valve 12 is opened, and when rotated clockwise, the throttle valve 12 is closed.

In the following description, defining the direction, represented by the upward direction in FIG. 1, passing through a cross point between a center axis X of the flow channel 11 and the axial center of the throttle shaft 13 and intersecting at right angles with these axes, as a reference direction, and a counterclockwise angle from the reference direction (Y axis) as $\theta$, an explanation will be given while referring to this angle.

As the throttle valve 12, those of an ellipsoidal shape having a major axis slightly larger than an inner diameter of the flow channel 11 are usually used. Therefore, when the degree of opening of the throttle valve 12 is represented by an angle from the Y axis of an upper half part of the throttle valve (a part that will revolve upstream when the throttle valve rotates in an opening direction: a first half part), the throttle valve 12 is brought into a full-close state at a predetermined micro angle $\theta=\alpha$, and into a full-open state at approximately $\theta=90°$. That is, the upper half part of the throttle valve 12 is revolved within the range of $\alpha \leqq \theta \leqq 90°$, while a lower half part (second half part) of the throttle valve 12 is revolved within the range of $\alpha+180° \leqq \theta \leqq 270°$.

As shown in FIG. 2, a sensor unit 20 is attached to a lateral side of the throttle body 10 according to the present embodiment. The sensor unit 20 is provided with an intake air temperature sensor 22 and a pressure sensor 23 in addition to a throttle position sensor (TPS) 21 that detects an opening degree of the throttle valve in conjunction with a revolving angle of the throttle shaft 13.

The sensor unit 20 is formed with an intake air temperature sensor attaching portion 24 that extends from the unit body, and the intake air temperature sensor 22 is disposed at a tip end of the intake air temperature sensor attaching portion 24. On the other hand, the throttle body 10 is formed with an intake air temperature sensor guiding path 14 through which the intake air temperature sensor attaching portion 24 penetrates, so as to be approximately parallel with the throttle shaft 13. In other words, the intake air temperature sensor guiding path 14 communicates between the flow channel 11 and the exterior from the lateral side of the throttle body 10, and when the sensor unit 20 is attached to the throttle body 10, the intake air temperature sensor attaching portion 24 will project into the flow channel from the inner peripheral wall 11 by a length d after passing through the intake air temperature sensor guiding path 14.

Figure 3:
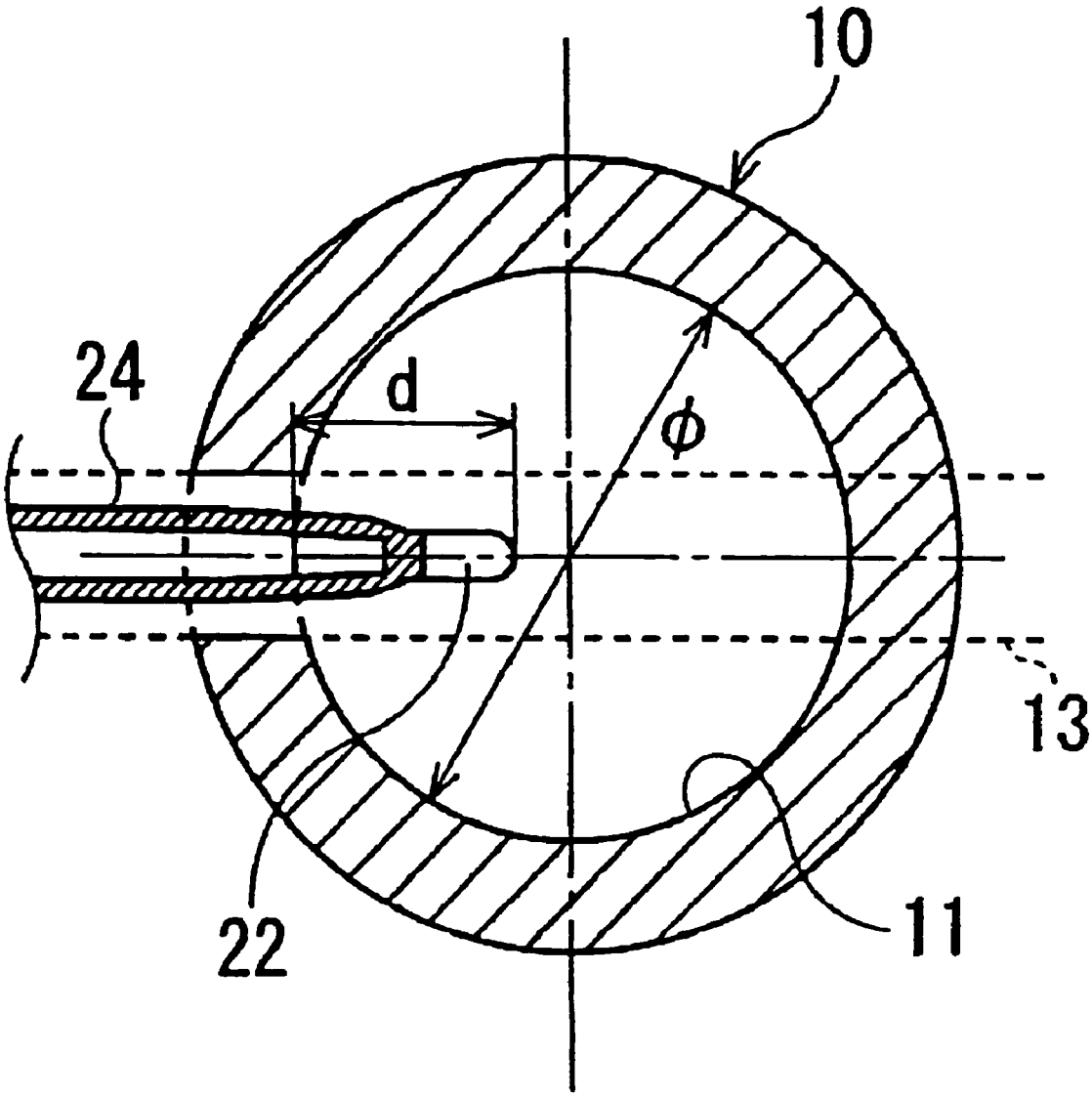
FIG. 3 is a schematic traverse cross-section taken along a line III-III shown in FIG. 2.

As shown in FIGS. 2 and 3, the intake air temperature sensor attaching portion 24 is disposed in an upstream region corresponding to the front shaft width of the throttle shaft 13 (the region where the throttle shaft 13 passes when it is translated upstream along the center axis X) in the upstream side of the throttle shaft 13. Accordingly, it is possible to minimize the influence of the intake air temperature sensor 22 and the intake air temperature sensor attaching portion 24 on the downstream side. In the present embodiment, the intake air temperature sensor attaching portion 24 is disposed (at the same height with the axis of the throttle shaft) so as to traverse almost the center of the flow channel 11.

Furthermore, the intake air temperature sensor 22 should preferably be disposed away from the wall surface of the flow channel 11 so as not to be influenced by the throttle body 10. In the present embodiment, as a range that is not substantially influenced by heat, the length d is set within the range about $9/32 \leqq d/\phi \leqq 1/2$ when the inner diameter of the flow channel 11 is represented by "ϕ".

The intake air temperature sensor 22 should be located at a position where it does not contact the throttle valve 12 because the intake air temperature sensor 22 will project in front of the throttle shaft 13 within the flow channel 11. Therefore, when the intake air temperature sensor 22 extends to the center of the flow channel, the intake air temperature sensor 22 is located at a position farther than the length of the major axis of the throttle valve 12 from the axial center of the throttle shaft 13. In other words, when the length of the major axis of the throttle valve 12 is represented by "D", the intake air temperature sensor 22 is located outside the circle having a diameter of D centered at the axial center of the throttle shaft 13 (see FIG. 1). However, as the position of the intake air temperature sensor 22 separates from the center axis (approaches the inner wall of the flow channel), the throttle shaft 13 will approach the axial center. In other words, the shorter the intake air temperature sensor attaching portion 24, the closer the intake air temperature sensor 22 is allowed to approach the throttle shaft 13 along the X axis, along the circular or ellipsoidal circumference of the throttle valve 12.

Furthermore, on a lateral wall of the throttle body 10, a pressure guiding path 15 that guides a pressure to the pressure sensor 23 disposed in the sensor unit 20, is provided on the downstream side of the throttle valve 12. The pressure guiding path 15 should be disposed so as to be influenced by the wake flow of the throttle valve 12 as less as possible. For example, when the pressure guiding path 15 is provided in a region satisfying $270° \leqq \theta \leqq 360°$ (downstream region of the upper half part), both the upper half part and the lower half part of the throttle valve 12 do not revolve in this region, and the upper half part of the throttle valve 12 will separate from this region as the opening degree of valve increases. Accordingly, the inlet of the pressure guiding path 15 can be located much closer to the throttle shaft 13 (inside the circle having a diameter D).

Figure 4:
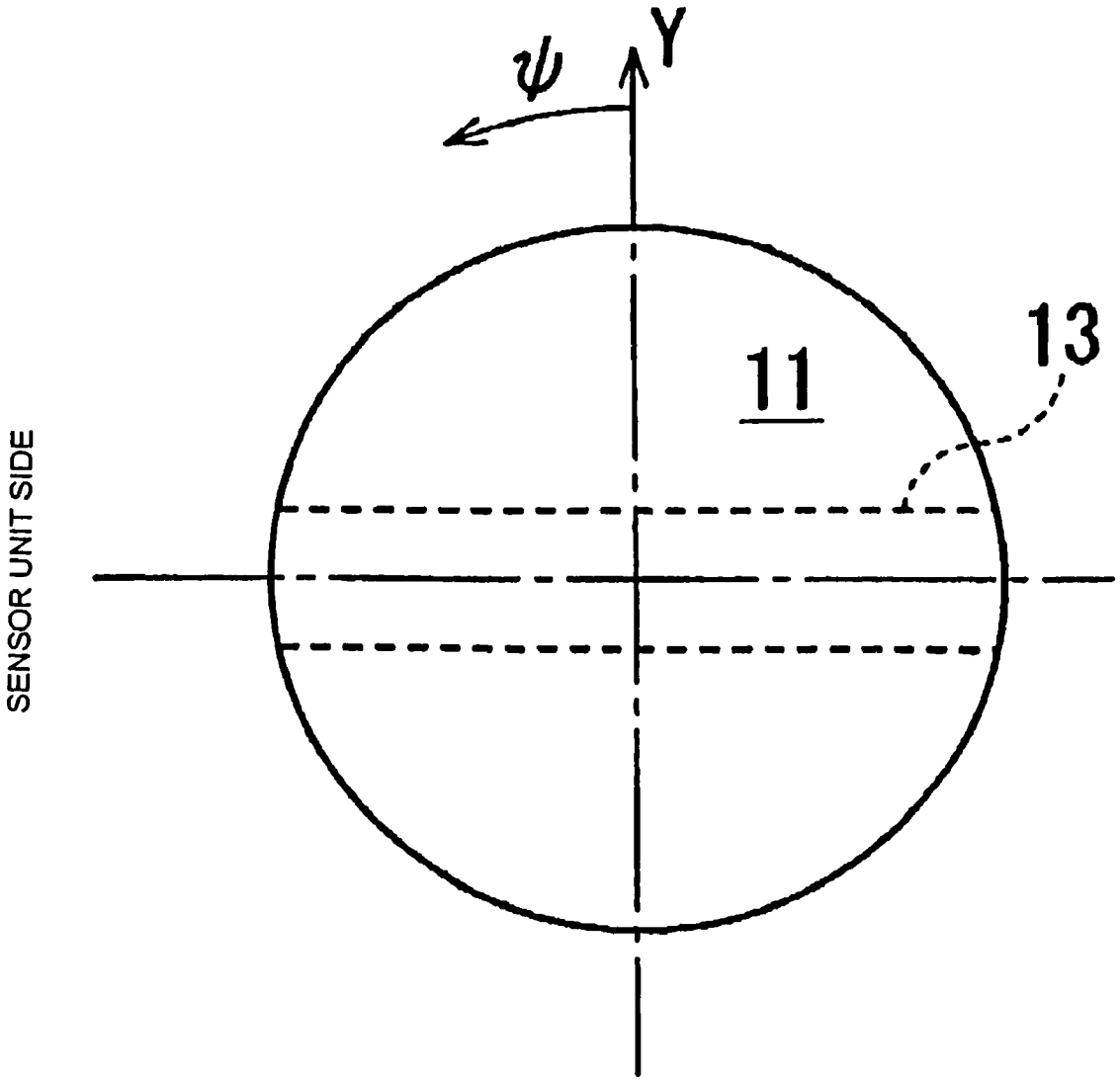
FIG. 4 is a schematic for explaining a position of an inlet of a pressure guiding path in a direction along an inner circumference of the flow channel.

Next, a position of an inlet of the pressure guiding path 15 in the direction along the inner circumference of the flow channel 11 will be explained with reference to FIG. 4. Taking an angle from the Y axis toward the direction in which the sensor unit 20 is attached as ψ, the inlet of the pressure guiding path 15 is located in the range of $0° \leqq \psi \leqq 90°$. In order to reduce the length of the pressure guiding path 15, the inlet of the pressure guiding path 15 is preferably provided within the range of $45° \leqq \psi \leqq 90°$. For the purpose of preventing foreign substances from entering the pressure guiding path 15, the direction of Y axis is preferably the direction that will direct upward when the throttle body 10 is attached to an engine block.

Furthermore, in the air-intake device according to the present embodiment, two screws 30, 31 that attach the sensor unit 20 to the throttle body 10 (see FIG. 6) are provided, and these screws 30, 31 are situated in a region satisfying $0° \leqq \theta \leqq 90°$ (upstream region of upper half part) and in a region satisfying $180° \leqq \theta \leqq 270°$ (downstream region of lower half part). The screws 30, 31 can be arranged close to the throttle shaft 13 and in a region overlapping with the flow channel 11 because the pressure sensor 23 and the intake air temperature sensor 22 are disposed as described above. In other words, the screws 30, 31 are arranged on a lateral side, for example, at heights within about ψ/2 above and below the throttle shaft 13 in a plane viewed from the axial direction of the flow channel 11, as shown in FIG. 3.

Figure 5:
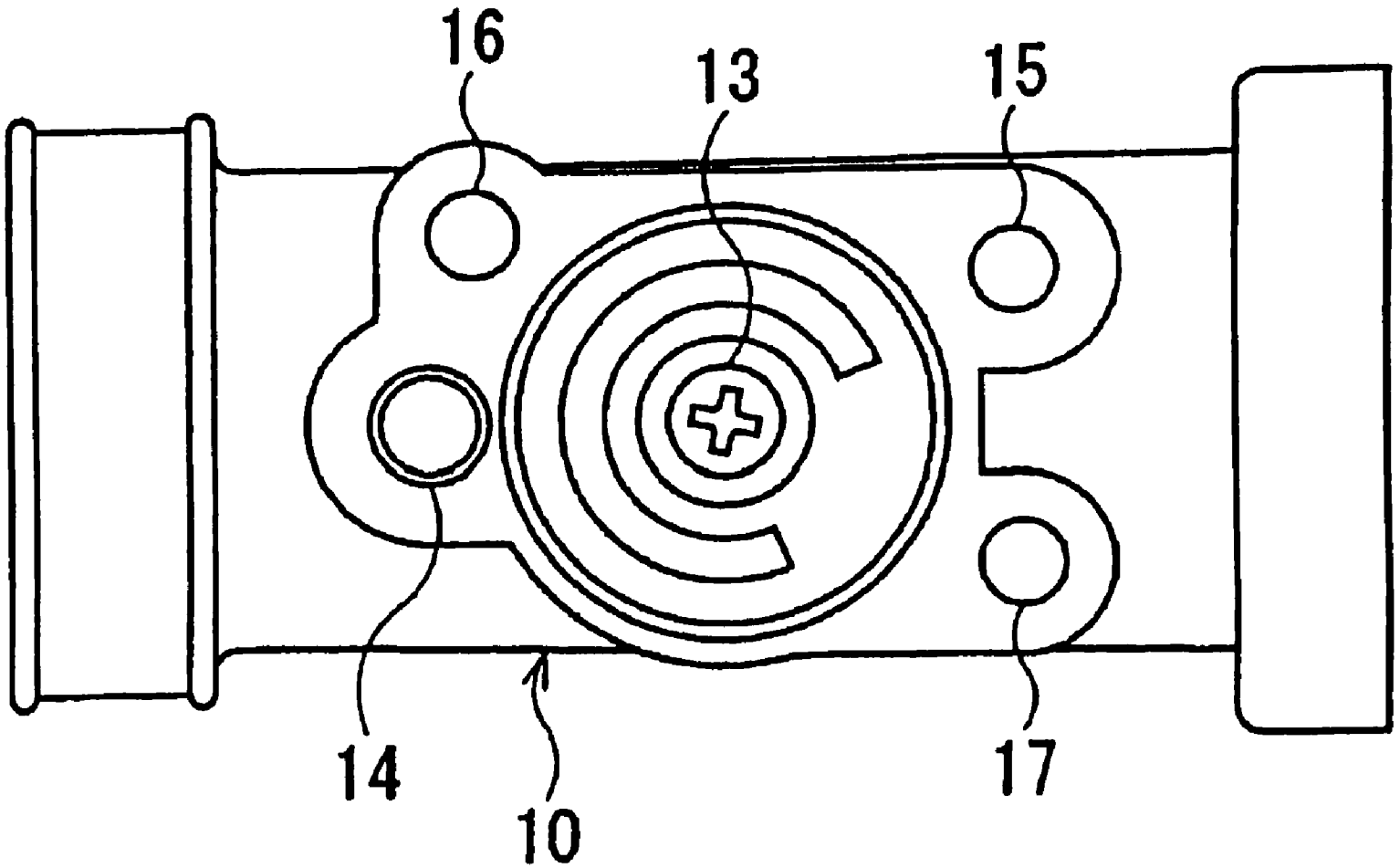
FIG. 5 is a side view of the throttle body on a side to which a sensor unit is attached when the sensor unit is removed.
Figure 6:
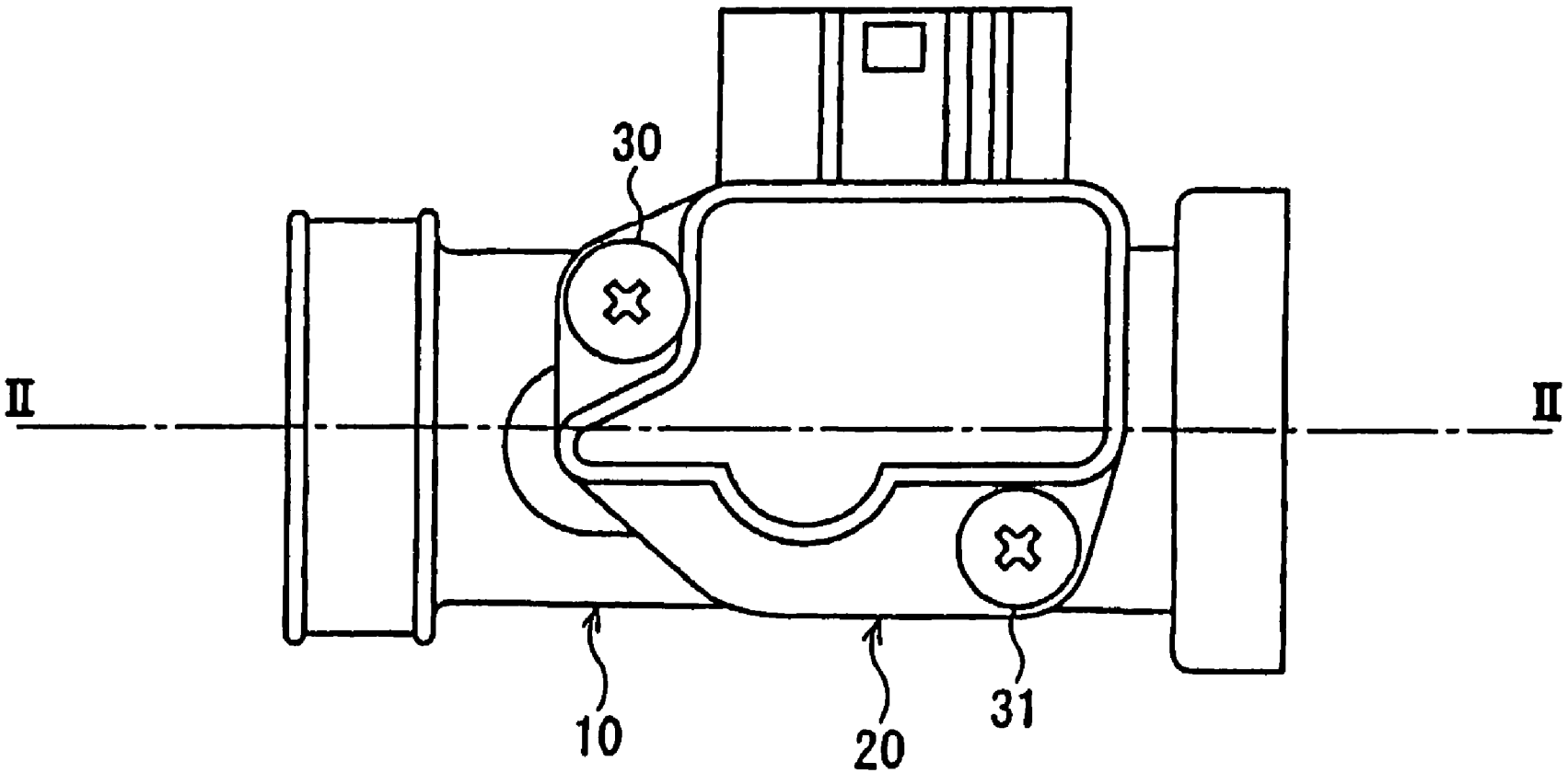
FIG. 6 is a side view of the air-intake device on the same side as the side shown in FIG. 5 when the sensor unit is attached.

FIG. 5 is a side view of the throttle body 10 on the side where the sensor unit 20 is attached. As shown in FIG. 5, on the lateral side of the throttle body 10, since screw holes 16, 17 for attachment of the screws 30, 31 can be arranged symmetrically along the diagonal line centered at the throttle shaft 13 (see FIG. 6), it is possible to attach the sensor unit 20 to the throttle body 10 very stably. Furthermore, since no sensor is provided in these regions, the screw holes 16, 17 can be provided close to the throttle shaft 13, which further promotes miniaturization of the sensor unit 20. FIG. 6 is a side view of the throttle body 10 in the state that the sensor unit 20 is attached.

Figure 7:
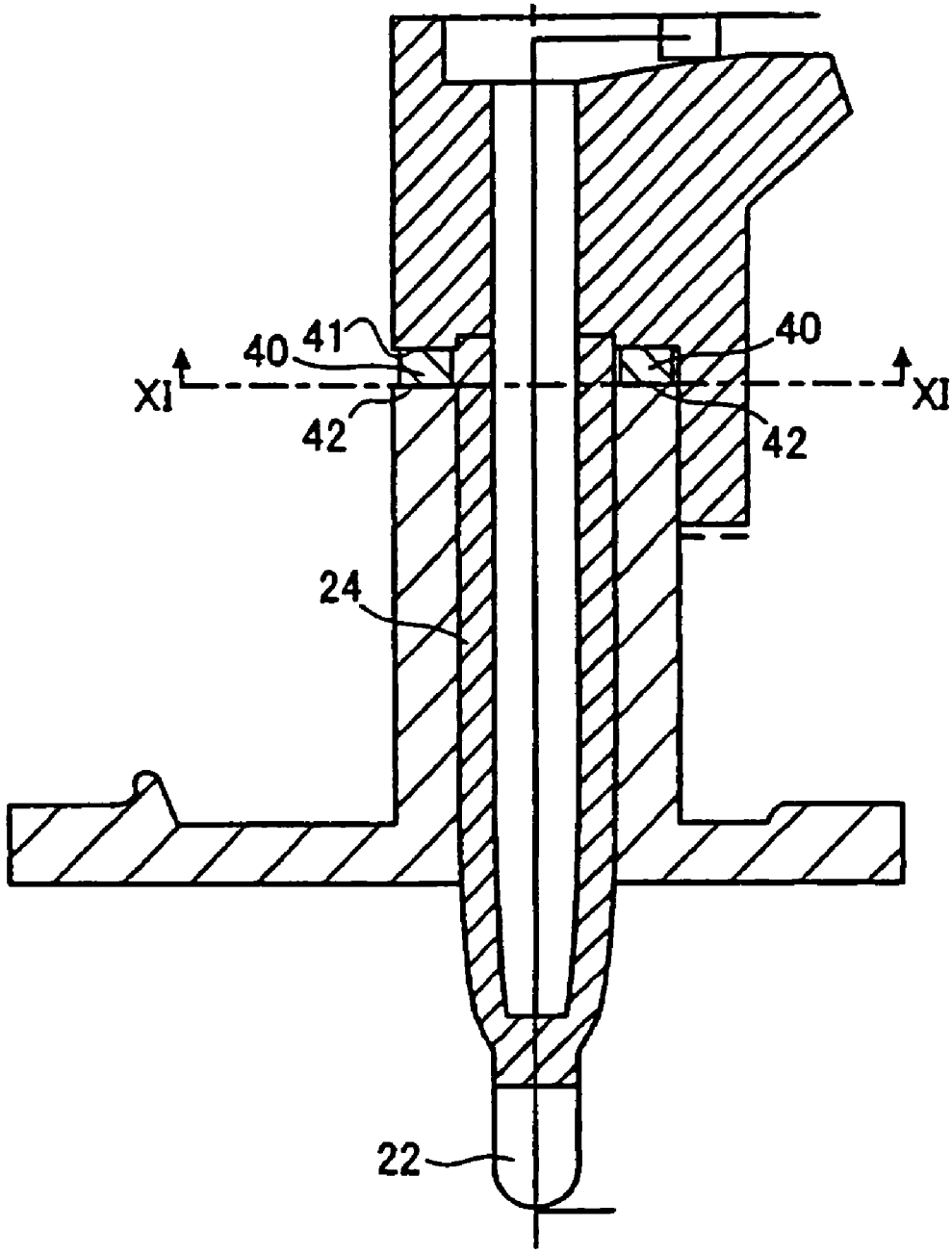
FIG. 7 is an enlarged view of FIG. 2.
Figure 8:
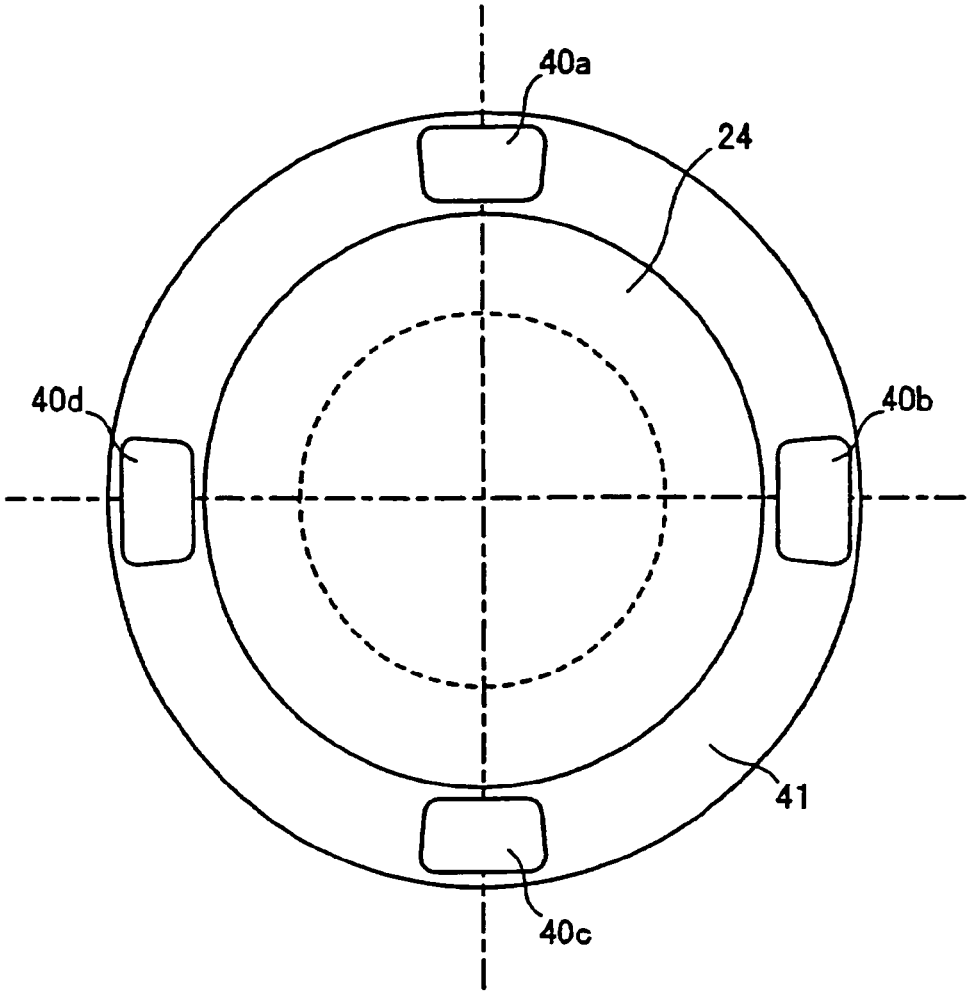
FIG. 8 is a cross-section taken along a line XI-Xi shown in FIG. 7.

FIG. 7 is an enlarged view of FIG. 2, and FIG. 8 is a cross-section taken along a line XI-XI shown in FIG. 7. In FIG. 7 and FIG. 8, at least two projecting members 40 (40*a* to 40*d*) are provided in a part in contact with a cross section of the inlet of the intake air temperature sensor guiding path in the intake air temperature sensor attaching portion 24. The projection member 40 is so designed that it will abut on a cross section 42 of the inlet of the intake air temperature sensor guiding path, when the intake air temperature sensor attaching portion 24 is attached to the throttle body 10. In this manner, the sensor unit 20 is prevented from coming into direct contact with the cross section 42 of the inlet of the intake air temperature sensor guiding path of the throttle body 10.

That is, by bringing the cross section 42 of the inlet of the intake air temperature sensor guiding path of the throttle body 10 and the intake air temperature sensor attaching portion 24 into contact with each other via the projection member 40, it is possible to reduce the area in which they abut with each other, and to provide a space between them, resulting in that heat conduction from the throttle body 10 can be effectively mitigated that otherwise occurs when the cross section 42 of the inlet of the intake air temperature sensor guiding path of the throttle body 10 and a cross section 41 of the intake air temperature sensor attaching portion 24 are fitted with each other on their planes. In addition, by reducing the abutting area between the cross section 42 of the inlet of the intake air temperature sensor guiding path of the throttle body 10 and the cross section 41 of the intake air temperature sensor attaching portion 24, it is possible to improve the strength of fitting compared to the case where they are fitted with each other on their planes. Accordingly, it is possible to attach the sensor unit 20 to the throttle body 10 in a stable manner.

The projection member 40 is provided at four diagonal positions so that the neighboring projection members 40 are apart by approximately 90° with respect to each other. In order to secure the fitting between the sensor unit 20 and the throttle body 10, the projection members 40 are preferably arranged at constant intervals so that even power is applied to each projection member 40. The number of the projection members 40 is not limited to "4" but may be "3" (interval between projection members 40 is approximately 120°) or "5" (interval between projection members 40 is approximately 72°) or more. The larger the number of the projection members 40 the more stable the fitting can be achieved, with contradictory deterioration in mitigating effect of heat conductivity. Therefore, as for the number, size and shape of projection member 40, it is preferred to create a design while considering fitting stability and the mitigating effect of heat conductivity and the like.

Figure 9:
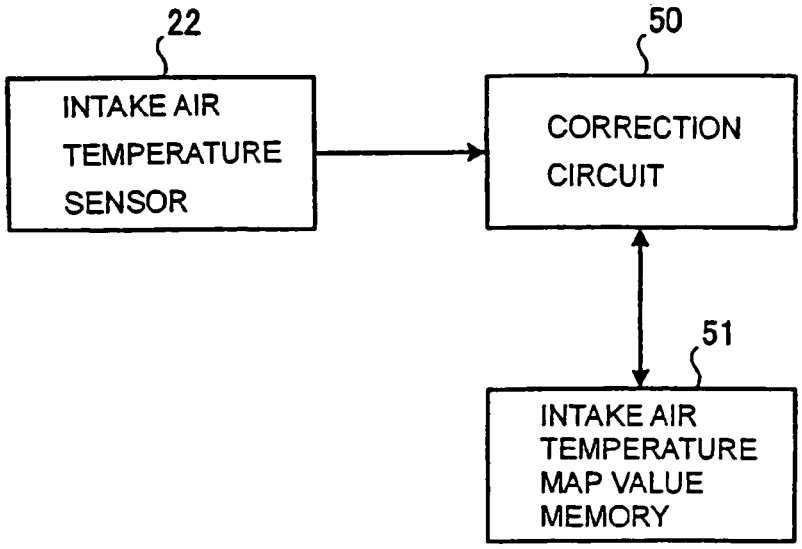
FIG. 9 is a block diagram of one example of the air-intake device.

Usually, the intake air temperature sensor 22 is preferably located near an air cleaner (omitted in drawings) and detects intake air temperature near the air cleaner. However, in the present embodiment, in order to realize compact configuration, the intake air temperature sensor 22 is disposed near the throttle valve 12, namely at a position on the upstream side of the throttle shaft 13 in the flow cannel 11 of the throttle body 10 where it does not contact the throttle valve 12. Accordingly, there arises a difference from the intake air temperature detected in the vicinity of the air cleaner. For addressing this problem, a correction circuit 50 is provided that corrects a detection value detected by the intake air temperature sensor 22 into a value of intake air temperature in the vicinity of the air cleaner. FIG. 9 is a block diagram of one example of the air-intake device.

In FIG. 9, the correction circuit 50 detects a detection value detected in the intake air temperature sensor 22 into a value of an intake air temperature in the vicinity of the air cleaner. Also a map value memory 51 that stores a map value of intake air temperature is provided, and the correction circuit 50 corrects the detection value using an intake air temperature map value stored in the intake air temperature map value memory 51. As to the intake air temperature map value, a detection value (intake air temperature) in the vicinity of the throttle valve 12 and data concerning intake air temperature in the vicinity of the air cleaner corresponding to the intake air temperature are preliminarily measured, and the data is stored as the intake air temperature map value.

At least one of the correction memory 50 and the intake air temperature map value memory 51 is preferably provided in an ECU (Electronic Control Unit) of which a drawing is omitted, however, it may be provided separately from the ECU.

Figure 10:
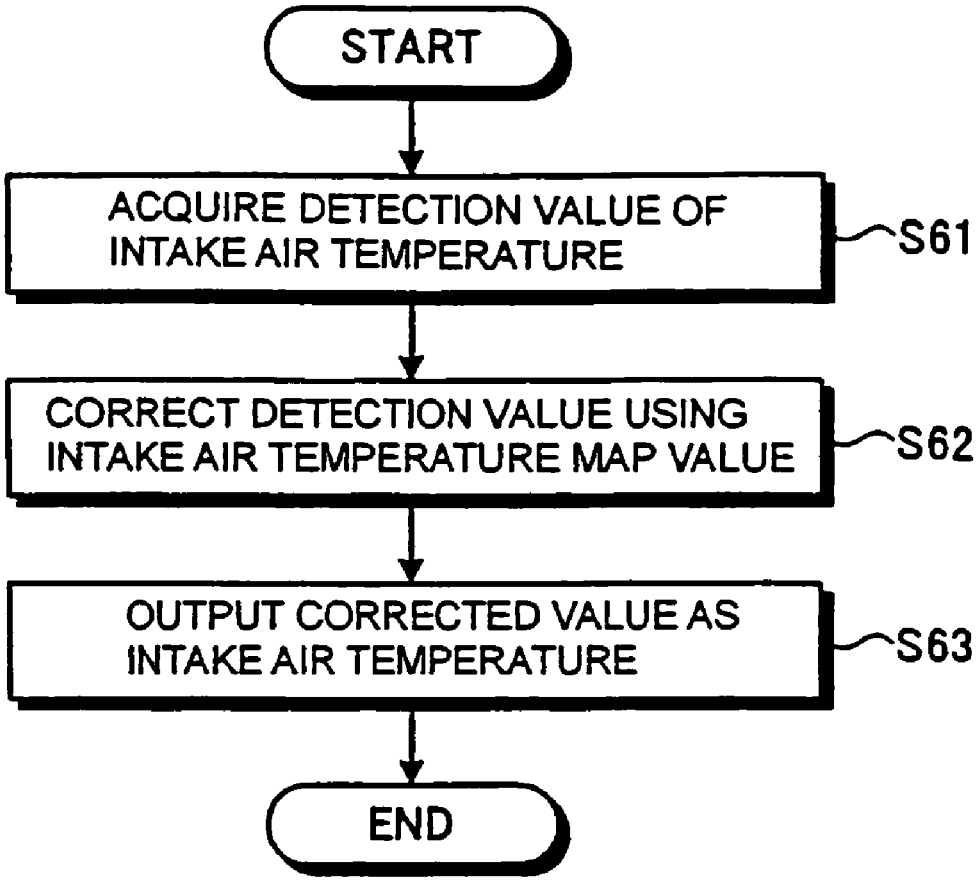
FIG. 10 is a flowchart of one example of an intake air temperature detection method.

FIG. 10 is a flowchart of one example of an intake air temperature detection method. In the flow chart of FIG. 10, first a detection value of intake air temperature in the vicinity of the throttle valve 12 is acquired by the intake air temperature sensor 22 (step S61). Then using the intake air temperature map value stored in the intake air temperature map value memory 51, the detection value is corrected into an intake air temperature in the vicinity of the air cleaner (step S62). Then the corrected value is outputted as an intake air temperature (step S63).

As described above, according to the present embodiment, by arranging the pressure sensor, the pressure guiding path inlet, the intake air temperature sensor and the attaching screws in the manner as described above, any sensor and attaching screw can be disposed close to the throttle shaft provided with TPS, and the size of the sensor unit can be significantly reduced. It is especially suited for two-wheeled vehicles of small displacement (for example, a scooter) in which a space for mounting an exhauster is limited. Each sensor can be arranged in a good condition and the sensor unit can be attached to the throttle body in stable condition.

Further, by employing the arrangement as in the present embodiment, the same sensor unit can be readily used for air-intake devices which are different in bore size (inner diameter of the flow channel). In other words, when the bore size differs, the diameter of the throttle valve also differs, so that it becomes necessary to change the position of the pressure guiding path for each air-intake device; however, by arranging in the manner as described in the present embodiment, the pressure guiding path can be disposed at the same position for many air-intake devices having different bore sizes, so that the same unit can be employed for more kinds of air-intake devices. Furthermore, by setting the length of the intake air temperature sensor at ½ of a minimum bore size of the air-intake devices sharing the sensor unit, it is possible to extend the range of adaptable bore sizes.

In the present embodiment, an explanation was given while taking an ellipsoidal throttle valve in which $\alpha$ is a finite small angle as an example, however, when the throttle valve is circular, an approximation of $\alpha=0$ can be used.

INDUSTRIAL APPLICABILITY

As described above, the present invention is suitable for an air-intake device of an internal combustion engine (especially in a compact two-wheel vehicle), and a sensor unit that is mounted on a throttle body.

The invention claimed is:

1. An air-intake device using a butterfly-type throttle valve, comprising:

a throttle body including a flow channel;

a throttle shaft arranged so as to be rotatable relative to the throttle body;

a throttle valve held by the throttle shaft;

a sensor unit including a temperature sensor for intake air and a pressure sensor, the sensor unit being mounted on the throttle body;

a first attaching unit configured to attach the sensor unit to the throttle body; and a second attaching unit configured to attach the sensor unit to the throttle body, wherein the temperature sensor is disposed at a position upstream of the throttle shaft in the flow channel so as not to contact the throttle valve, an inlet of a guiding path in the flow channel is arranged downstream of a first half part of the throttle valve that is revolved in an upstream direction when the throttle valve is revolved in an opening direction, the guiding path guiding a pressure to the pressure sensor, the first attaching unit is disposed at a position upstream of the first half part, the second attaching unit is disposed at a position downstream of a second half part of the throttle valve that is revolved in a downstream direction when the throttle valve is revolved in the opening direction, the sensor unit includes an attaching portion to which the temperature sensor is attached, the attaching portion projecting into the flow channel along the throttle shaft from an inner peripheral wall of the flow channel, and a length by which the temperature sensor attached to the attaching portion projects from the inner peripheral wall is equal to or less than approximately half of an inside diameter of the flow channel.

2. The air-intake device according to claim 1, wherein the first attaching unit and the second attaching unit are arranged on a side of the flow channel at respective positions where a distance from an axial center of the throttle shaft is equal to or less than approximately half of an inside diameter of the flow channel on a traverse section of the flow channel.

3. The air-intake device according to claim 1, further comprising a throttle position sensor attached to the throttle shaft.

4. A two-wheeled vehicle, comprising the air-intake device according to claim 1.

5. An air-intake device comprising:

a temperature sensor for intake air disposed at a position upstream of a throttle shaft within a flow channel of a throttle body so as not to contact the throttle valve; and a correction circuit configured to correct a value detected by the temperature sensor so as to correspond to a value of temperature of intake air near an air cleaner.

6. The air-intake device according to claim 5, further comprising a memory configured to store a temperature map of intake air, wherein the correction circuit is configured to correct the detected value based on the temperature map.

7. A sensor unit, comprising:

a temperature sensor guiding path; and an attaching portion including at least two projection members that are arranged at portions that contact a cross-section of an inlet of the temperature sensor guiding path such that the projection members and the cross section abut to each other.

8. The sensor unit according to claim 7, wherein the projection members are arranged at regular intervals.

9. A two-wheeled vehicle, comprising the sensor unit according to claim 7.

10. A method of detecting temperature of intake air, comprising:

acquiring a detection value from a temperature sensor for intake air disposed at a position upstream of a throttle shaft in the flow channel so as not to contact the throttle valve;

correcting the detection value so as to correspond to a value of temperature of intake air near an air cleaner; and outputting the corrected value.

11. The method according to claim 10, wherein the correcting includes correcting the detection value based on a temperature map of intake air stored in a memory.

* * * * *